US005135455A

United States Patent [19]

King et al.

[11] Patent Number: 5,135,455

[45] Date of Patent: Aug. 4, 1992

[54] USER FRIENDLY HAND HELD WEIGHT

[75] Inventors: Jon E. King; Bradley G. Stack, both of St. Louis, Mo.

[73] Assignee: Sinclair & Rush, Inc., St. Louis, Mo.

[21] Appl. No.: 680,059

[22] Filed: Apr. 3, 1991

[51] Int. Cl.[5] ..... A63B 21/072

[52] U.S. Cl. ..... 482/108; 482/105

[58] Field of Search ..... 272/67, 68, 117, 119, 272/122, 123, 143

[56] References Cited

U.S. PATENT DOCUMENTS

| | | | |
|---|---|---|---|
| 1,918,142 | 7/1933 | Smith | 272/122 |
| 3,734,493 | 5/1973 | Hasekian | 272/122 |
| 4,218,057 | 8/1980 | Wilson | 272/122 X |
| 4,351,526 | 9/1982 | Schwartz | 272/122 |
| 4,538,806 | 9/1985 | Wilkerson | 272/122 |
| 4,602,784 | 7/1986 | Budden et al. | 272/119 |
| 4,690,399 | 9/1987 | Hatashi | 272/122 |
| 4,743,016 | 5/1988 | Van Derworp et al. | 272/122 X |
| 4,778,173 | 10/1988 | Joutras | 272/122 X |
| 4,846,464 | 7/1989 | Jorno | 272/122 X |
| 4,936,571 | 6/1990 | Bohr | 272/122 X |

FOREIGN PATENT DOCUMENTS

| | | | |
|---|---|---|---|
| 2159061 | 11/1985 | United Kingdom | 272/122 |

*Primary Examiner*—Robert Bahr

*Attorney, Agent, or Firm*—Polster, Lieder, Woodruff & Lucchesi

[57] ABSTRACT

A user friendly dumbbell that is comfortable, safe and durable, and which also protects against damage to surfaces against which the dumbbell may come into contact is disclosed. The dumbbell is typically provided with an elongated shaft and enlarged members attached to opposite free ends of the elongated shaft. Surrounding protective and durable coverings are provided for the elongated shaft and enlarged members that is both user friendly during use, while also protecting supporting and other surfaces against damage when the dumbbell is not in use. The protective and durable covering along the elongated shaft includes a resilient and compressible element having at least one porous high density foam rubber covering. The protective covering on the enlarged members may include sculptured resilient and compressible bodies with a through passageway for receiving one of the opposite ends of the elongated shaft, or where the enlarged members comprise a weight attached to the elongated shaft, the protective covering is a coarse grain material that conforms in shape to the weights and is generally similar in exterior appearance to the porous high density foam rubber covering. For certain uses, an adjustable strap is utilized to enable the dumbbell to be gripped and conveniently held on the hand during use. The adjustable strap includes spaced adjustable straps which are constructed to overlap one another and include fastening means in order to be secured in an adjustable fitted relationship to a user's hands when gripping the elongated shaft.

24 Claims, 10 Drawing Sheets

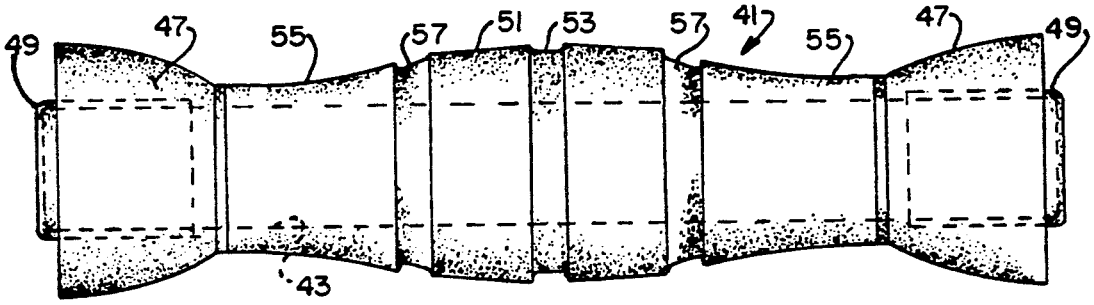
FIG. 13.
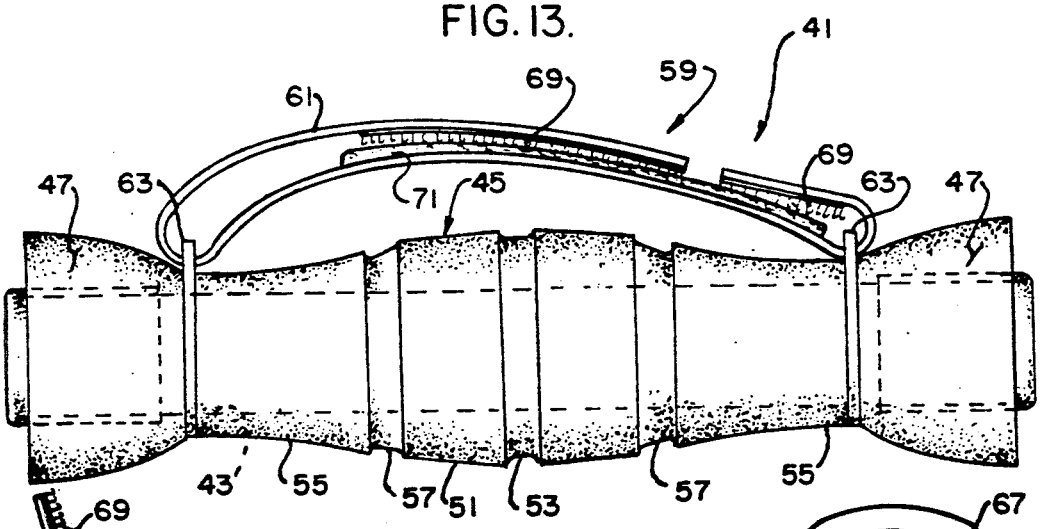
FIG. 14.
FIG. 14A.
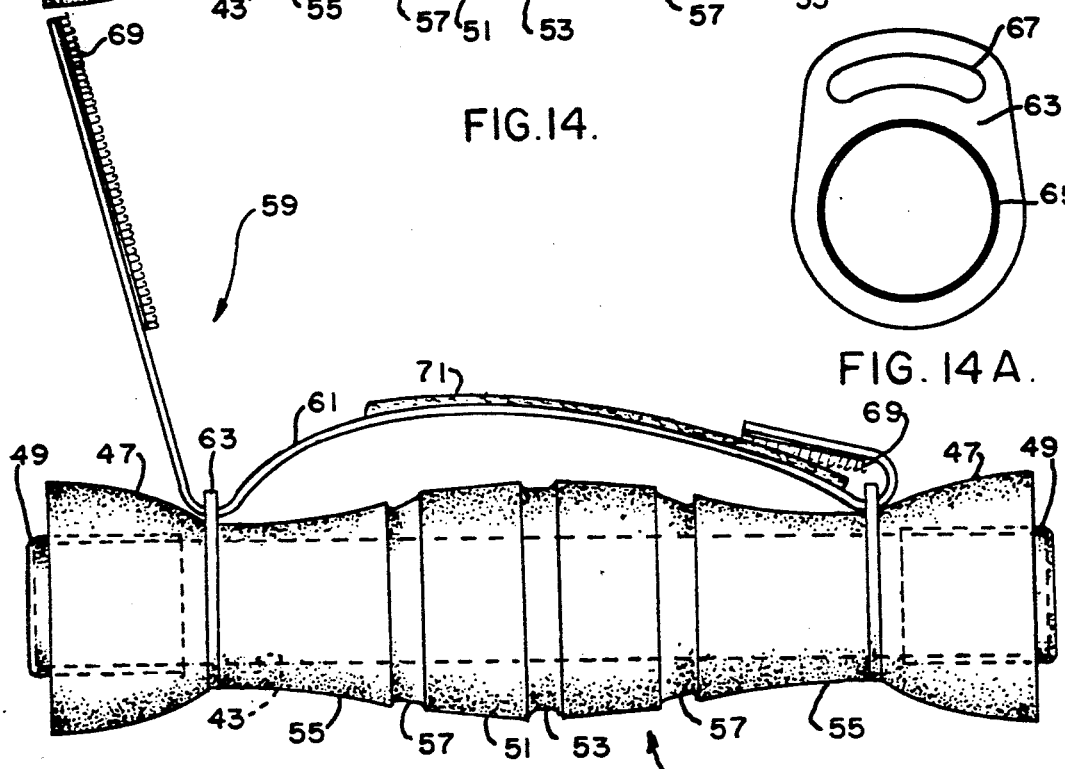
FIG. 15.

USER FRIENDLY HAND HELD WEIGHT

CROSS REFERENCE TO RELATED APPLICATIONS

This application is a utility patent application that is related to the following prior copending design patent applications: Ser. No. 07/665,431 filed Feb. 25, 1991, now pending; Ser. No 07/660,580 filed Feb. 25, 1991, now pending; Ser. No. 07/660,581 filed Feb. 25, 1991, now pending; and Ser. No. 07/660,582 filed Feb. 25, 1991, now pending.

BACKGROUND OF THE INVENTION

The present invention relates to a hand held weight or dumbbell which is designed for comfort, safety and durability, and more particularly to a hand held weight which is user friendly during use while also protecting against damage to supporting and other surfaces when not in use.

For arm, shoulder and chest development, hand held weights or dumbbells have long been employed. Typically, such hand held weights or dumbbells include a pair of rounded weights on each end of a elongated shaft. In some cases, the weights are adjustably mounted to each end of an elongated shaft, such as by threaded connections and the like, as shown in U.S. Pat. Nos. 984,721 or 1,672,944. Prior art hand held weights or dumbbells have been made from various materials including iron, chrome and sand filled plastic weights. As is well known, such products are not only unsightly, they do not appeal to potential customers. Moreover, they are difficult to grip and hold during exercise routines. To facilitate gripping of dumbbells, soft resilient materials, such as rubber pads and grips have been employed, such as disclosed in U.S. Pat. No. 1,991,520 and British Patent No. 550,961. Soft resilient grips, with cooperating straps or members for engaging the back of a hand, are also disclosed in U.S. Pat. Nos. 4,351,526; 4,627,618 and 4,846,464. While the devices shown in these patents have materially improved the use and performance of dumbbells, they have not provided all the features desired, where user friendliness including comfort, safety and durability during use is desired. In addition, they do not protect the user during use, while protecting surfaces against damage by the dumbbell when not in use.

From the discussion that follows, numerous other features of the present invention will also become apparent from the detailed description of the invention.

SUMMARY OF THE INVENTION

Among the several objects and advantages of the present invention may be noted:

The provision of a new and improved user friendly hand held weight that provides comfort, safety and durability during body toning or body sculpting or aerobic exercising or aerobic walking use;

The provision of the aforementioned user friendly hand held weight that also protects surfaces against damage when the dumbbell is not in use.

The provision of the aforementioned user friendly hand held weight that includes a surrounding protective and durable covering for the dumbbell elongated shaft and enlarged members at opposite ends of the shaft, in order to provide user friendly use and protection against surfaces when not in use;

The provision of the aforementioned user friendly hand held weight wherein the surrounding protective and durable covering for the dumbbell elongated shaft includes a resilient and compressible element on the dumbbell elongated shaft, which may also be ergonomically designed to assure a tight hold during use;

The provision of the aforementioned user friendly hand held weight wherein the surrounding protective and durable covering on the dumbbell elongated shaft and enlarged members at opposite ends of the shaft may be colored as desired for aesthetic and size coding;

The provision of the aforementioned user friendly hand held weight which, in certain cases where the enlarged members comprise weights attached to the ends of the elongated dumbbell shaft, includes a protective and durable covering that is a coarse grain material conforming to the shape of the weights and which also has an exterior appearance generally similar to the exterior appearance of the resilient and compressible element provided on the dumbbell elongated shaft;

The provision of the aforementioned user friendly hand held weight which, in certain instances, may be made in different sizes, or in other instances, may comprise threaded weights or the like attached to opposite ends of the dumbbell elongated shaft for ease of replacement;

The provision of the aforementioned user friendly hand held weight which may also be provided with an adjustable strap that is quickly and easily adjusted and fitted to the hand of a user;

The provision of the aforementioned user friendly hand held weight wherein the adjustable strap includes quick release/attachment fasteners to quickly and readily attach and detach the adjustable strap to a user's hand, as desired;

The provision of the aforementioned user friendly hand held weight which, in addition to all of the other aforementioned advantages and features, is economical in cost to the user, and which also provides an effective workout to the user at whatever level of fitness the user has attained.

According to the present invention, the user friendly hand held weight of the present invention includes an elongated shaft with enlarged members attached to opposite free ends of the elongated shaft. The elongated shaft and enlarged members include surrounding protective and durable covering means that is user friendly during use while protecting supporting and other surfaces against damage when the dumbbell is not in use.

The protective and durable covering means along the elongated shaft includes resilient and compressible means to facilitate gripping and use of the dumbbells. Preferably, the resilient and compressible means comprises at least one high density foam rubber covering, although it could be made as a multi-piece element, if desired.

The resilient and compressible means on the elongated shaft is also ergonomically designed or sculptured with smaller end sections adjacent the enlarged elements and a larger intermediate section. The larger intermediate section may be generally cylindrical in shape, with the smaller end sections tapering downwardly away from the larger intermediate cylindrical section. One or more gripping grooves may be provided in the larger intermediate section and/or the end sections, as desired.

The durable and protective coating on the enlarged members may include sculptured resilient and compressible bodies having a through passageway for receiving one of the opposite ends of the elongated shaft. In this construction, an end cap fits over one of the opposite ends and an adjacent portion of the elongated shaft, with each end cap being trapped between a sculptured resilient and compressible body and the elongated shaft.

In another embodiment, the enlarged members at opposite ends of the elongated shaft may comprise weights which are either permanently or threadably attached to the elongated shaft. In either case, the weights are provided with a durable and protective covering in the form of a coarse grain covering that generally conforms to the shape of the weights and is generally similar in exterior appearance to the resilient and compressible element along the elongated shaft. For this purpose, the coarse grain covering comprises a dip molded polyvinylchloride covering with a coarse grain exterior surface that is formed to the shape of the weights at opposite ends of the elongated shaft.

In certain instances, the user friendly hand held weight may be provided with an adjustable strap means for adjustably fitting the dumbbell to a user's hand. The adjustable strap means will be adjustably fitted relative to the resilient and compressible element along the elongated shaft, in order to accommodate a user's hand.

The adjustable strap means preferably includes a pair of spaced adjustable straps, each of which are secured to the dumbbell adjacent the enlarged members The pair of spaced adjustable straps include fastening means which are constructed to overlap and secure one another in an adjustable fitted relationship to a user's hand when gripping the elongated shaft.

The adjustable strap means preferably comprises a single strap element which is connected to spaced strap retainers associated with each elongated shaft. Each strap retainer includes a first opening for receiving the elongated strap and a second opening for receiving the single strap element. Each end of the single strap element is provided with either a hook or pile type fastener and an intermediate area of the strap element is provided with the other of the hook and pile type fastener. This enables the single strap element to be folded over one of the strap retainers for engagement of complementary hook and pile fasteners, and with the other end of the single strap element folded over the other strap retainer for similar cooperative engagement so as to permit adjustable fastening of the complementary hook and pile fasteners on the single strap to one another.

These and other objects and advantages of the present invention will become more apparent from the description that follows.

BRIEF DESCRIPTION OF THE DRAWINGS

In the drawings.

FIG. 1 is a perspective view of one unique construction of user friendly hand held weight that is particularly designed for advanced weight workouts and body sculpting;

FIG. 2 is a front elevational view of the user friendly hand held weight shown in FIG. 1 which illustrates, in dotted lines, the manner in which the elongated shaft and adjustable weights are attached to one another;

FIG. 3 is an end elevational view of the user friendly hand held weight shown in FIGS. 1-2;

FIG. 4 is an exploded elevational view, partially in section, of the user friendly hand held weight shown in FIGS. 1-3 and illustrating the various components which are used in constructing this particular embodiment;

FIG. 5 is a perspective view of another type of user friendly hand held weight which is designed primarily for body toning/aerobics use;

FIG. 6 is a front elevational view of the user friendly hand held weight illustrated in FIG. 5, and showing in dotted lines some of the components of this particular weight;

FIG. 7 is an end elevational view of the user friendly hand held weight shown in FIGS. 5-6;

FIG. 8 is an exploded elevational view, partly in section, of the various components comprising the user friendly hand held weight illustrated in FIGS. 5-7 of the drawings;

FIGS. 9-16 illustrate a third embodiment which is generally shown as follows:

FIG. 9 is a perspective view of another embodiment which shows a different user friendly hand held weight with an adjustable strap, such construction being primarily for aerobic exercising/aerobic walking use;

FIG. 10 is a top plan view of the user friendly hand held weight shown in FIG. 9;

FIG. 11 is an end elevational view of the user friendly hand held weight shown in FIGS. 9-10 as viewed along lines 11—11 of FIG. 10;

FIG. 12 is an end elevational view of the user friendly hand held weight shown in FIGS. 9-10 as viewed along lines 12—12 of FIG. 10;

FIG. 13 is a bottom plan view of the user friendly hand held weight shown in FIGS. 9-16;

FIG. 14 is a front elevational view illustrating the user friendly hand held weight and adjustable strap shown in FIGS. 9-16;

FIG. 14A is an end elevational view of one of the strap retainers used for the adjustable strap in the FIGS. 9-16 embodiment;

FIG. 15 is also a front elevational view similar to FIG. 14, but illustrating in the manner in which the adjustable strap may be quickly and adjustably fitted to a user's hands;

FIG. 16 is an exploded elevational view, partly in section, of the various components comprising the user friendly hand held weight shown in the FIGS. 9-16 embodiment;

FIG. 17 is a perspective view of still another type of user friendly hand held weight which is depicted in the various views in FIGS. 17-24;

FIG. 18 is a top plan view of the user friendly hand held weight shown in FIG. 17;

FIG. 19 is an end elevational view of the user friendly hand held weight shown in FIGS. 17-18 as viewed along lines 19—19 of FIG. 18;

FIG. 20 is an end elevational view of the user friendly hand held weight shown in FIGS. 17-18 as viewed along line 20—20 of FIG. 18;

FIG. 21 is a bottom plan view of the user friendly hand held weight illustrated in FIGS. 17-20;

FIG. 22 is a front elevational view of the user friendly hand held weight illustrated in FIGS. 17-24 with the adjustable strap associated therewith;

FIG. 23 is a front elevational view similar to FIG. 22, but illustrating the manner in which the adjustable strap is quickly and easily manipulated for adjustably fitting a user's hand to the weight; and FIG. 24 is an exploded elevational view, partly in section, of the various components comprising the user friendly hand held weight illustrated in the FIGS. 17-24 embodiment.

Corresponding reference numerals will be used throughout the several figures of the drawings.

DESCRIPTION OF THE PREFERRED EMBODIMENT

Figure 1:
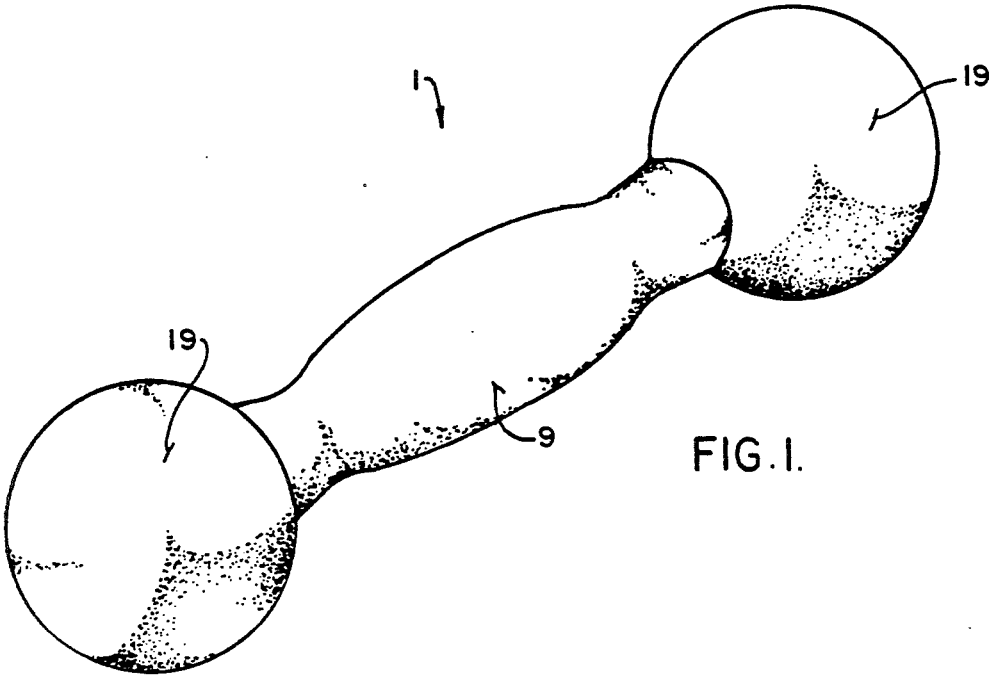
FIGS. 1-4 illustrate a first embodiment of the invention which is generally shown as follows.
Figure 2:
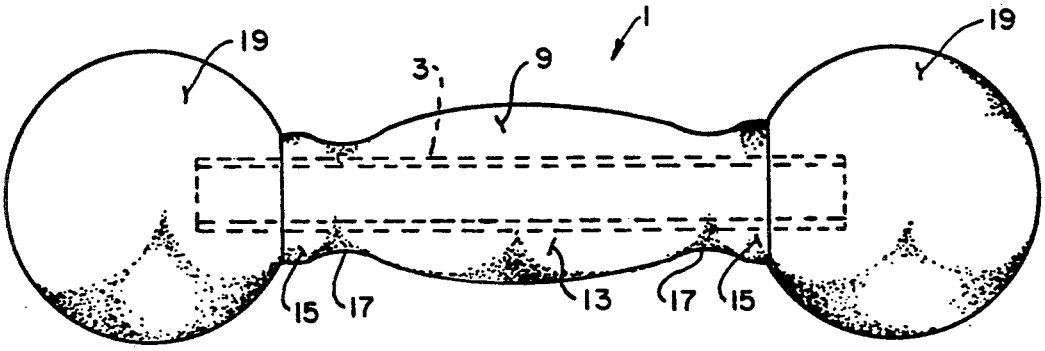
Figure 3:
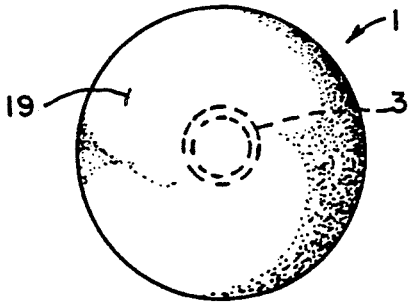

The following detailed description illustrates the invention by way of example and not by way of limitation. This description will clearly enable one skilled in the art to make and use the invention, and describe several embodiments, adaptions, variations, alternatives and uses of the invention, including what we presently believe is the best mode of carrying out the invention.

The present invention discloses four different embodiments as shown in FIGS. 1-4; 5-8; 9-16 and 17-24. The embodiment shown in FIGS. 1-4 corresponds to the design shown in design patent application Ser. No. 07/665,431 filed Feb. 25, 1991; the embodiment shown in FIGS. 5-8 corresponds to the design shown in design patent application Ser. No. 07/660,581 filed Feb. 25, 1991; the embodiment shown in FIGS. 9-16 corresponds to the design shown in design patent application Ser. No. 07/660,582 filed Feb. 25, 1991; and the embodiment shown in FIGS. 17-24 corresponds to the design shown in copending design patent application Ser. No. 07/660,580 filed Feb. 25, 1991.

Referring first to the FIGS. 1-4 embodiment, the user friendly hand held weight 1 includes a threaded steel elongated shaft 3 with enlarged generally spherically shaped gray iron castings 5 at opposite ends thereof, each of the castings 5 having complementary threaded openings 7 into which opposite free ends of the threaded elongated shaft 3 are threadably secured. While the spherically shaped castings or enlarged members 5, 5 may be threadably releasably secured to opposite free ends of the elongated threaded shaft 3, preferably in the FIGS. 1-4 embodiment, a high strength chemical adhesive is deposited over the complementary threaded sections of the elongated shaft 3 and enlarged members 5, and subsequently cured for permanently attaching the spherically shaped enlarged members 5 to opposite free ends of the threaded elongated shaft 3.

The ergonomically designed and/or sculptured protective and durable covering 9, which is mounted over the elongated shaft 9, is preferably formed as a resilient and compressible hand gripping element from high density foam rubber material, and has an outer configuration that is comfortably shaped to a user's hand. Specifically, the outer configuration of this resilient and compressible gripping element 9 includes a larger intermediate section 13 with smaller end sections 15, 15. The larger intermediate section 13 is gently reduced in size, on opposite sides thereof, into smaller diameter end sections 15, 15. Spaced a short distance from the outer free ends of each end section 15, 15, depressions 17, 17 may, in certain instances be provided, for receiving the fingers of a user; to aid in gripping the resilient and compressible hand gripping element 9.

Figure 4:
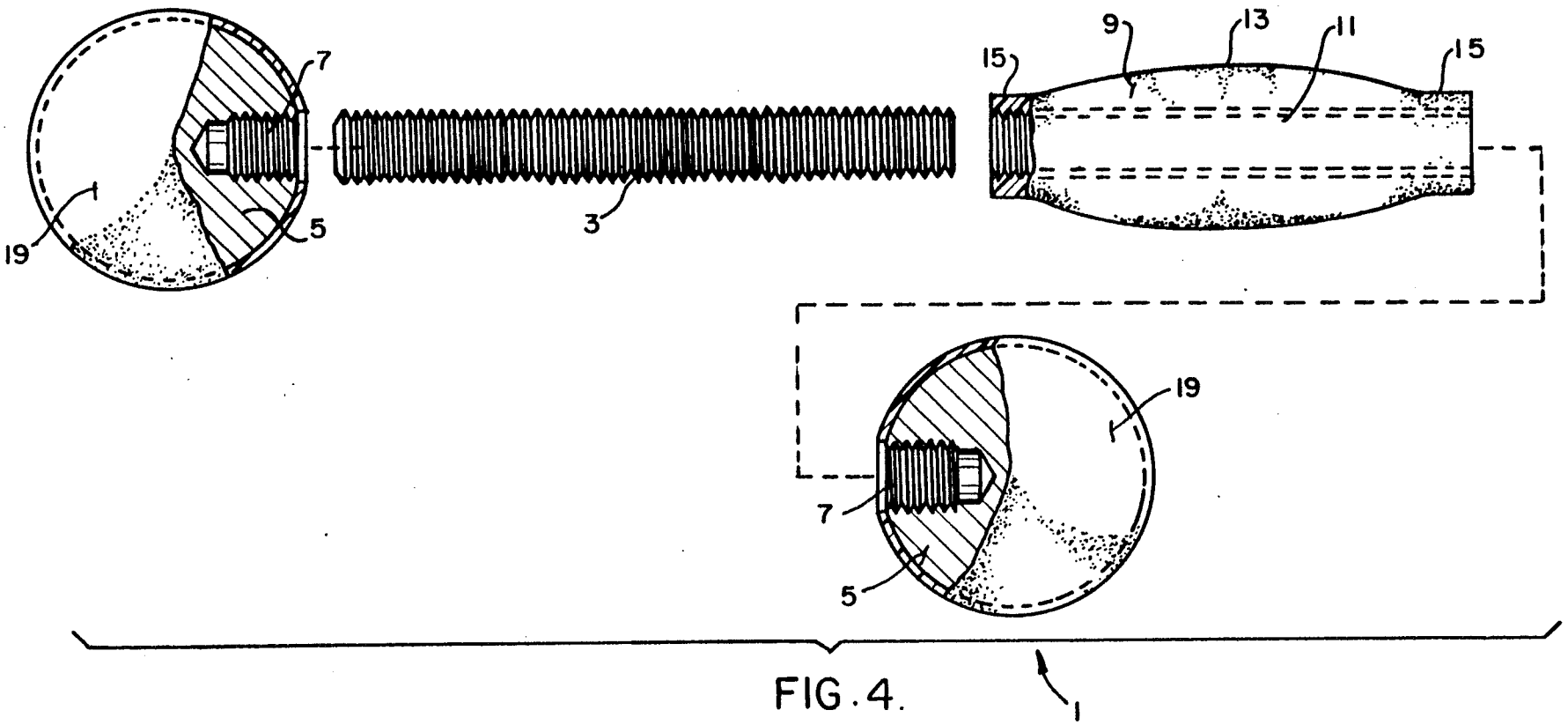

The manner in which the resilient and compressible hand gripping element 9 is mounted to the elongated threaded shaft 3 can be understood by referring to FIG. 4 of the drawings. Specifically, the ergonomically designed sculptured resilient and compressible hand gripping element 9 is positioned over the threaded elongated shaft 3 in engagement therewith. The resilient and compressible hand gripping element 9 is formed with a through opening 11 having the same or slightly smaller size than the maximum thread diameter of the elongated threaded shaft 3, in order that the resilient and compressible hand gripping element 9 can be retained in position on the elongated threaded shaft 3. When positioned over the threaded elongated shaft 3, the resilient and compressible hand gripping element 9 is centrally positioned on the threaded elongated shaft 3, so as to expose the opposite threaded ends of the elongated shaft 3 for complementary threaded engagement with the complementary threaded openings 7, 7 of each spherically shaped enlarged members 5, 5, as discussed above.

In addition to the surrounding durable and protective covering, in the form of the resilient and compressible hand gripping element 9 which surrounds the threaded elongated rod 3, each of the spherically shaped enlarged members 5, 5 are also provided with a surrounding durable and protective covering in the form of a coarse grain plastic material covering 19 that conforms in shape to the spherically shaped enlarged members 5, 5 and is generally similar in exterior appearance to the resilient and compressible hand gripping element 9. More specifically, the coarse grain plastic material covering 19 comprises a dip molded polyvinylchloride covering with a coarse grain exterior surface that covers the entire spherically shaped enlarged member 5, 5, except for the generally threaded area 7, 7. While dip molding is well known in the art, when a coarse grain polyvinylchloride or other similar chemical formulation is employed, a durable protective covering 19 is formed over each of the spherically shaped enlarged members 5, 5 which is conformed to the shape of the spherically shaped enlarged members 5, 5. At the same time, a covering is also provided that is similar in appearance to the high density foam rubber durable and protective element that forms the resilient and compressible hand gripping element 9 surrounding the threaded elongated shaft 3.

The hand held weight or dumbbell 1 described above in connection with FIGS. 1-4 of the drawings provides a user friendly hand held weight or dumbbell that is comfortable, safe and durable during use. The protective and durable covering in the form of the resilient and compressible hand gripping element 9, with its ergonomically or sculptured configuration, enables a user to obtain a comfortable, safe and effective work out, while the protective and durable covering 19, 19 surrounding the spherically shaped enlarged weights 5, 5 not only protects the user during use, but also protects floors and other surfaces against damage when the dumbbell is not in use. Both the high density foam rubber material, from which the resilient and compressible hand held element 9 is made, as well as the coarse grain plastic material, from which the coverings 19, 19 are made, repel perspiration and are easy to wipe clean. An additional feature that may not be readily apparent is that different colors may be employed for the resilient and compressible hand gripping element 9 and the coverings 19, 19 surrounding the spherically shaped enlarged weights 5, 5, thus providing color size coding, as well as eye catching appeal.

Many of the above noted advantages and features are also employed in the other embodiments of the present invention, as well as other features and advantages, as will become apparent in the description that follows with respect to the other embodiments of the present invention.

Reference is now made to FIGS. 5–8 of the present invention which shows user friendly hand held weight 21 of different construction. In this embodiment, the user friendly hand held weight 21 has a weighted elongated steel shaft or bar 23 over which is mounted the hand held durable and protective covering, in the form of the resilient and compressible hand gripping element 25, and enlarged members 27, 27 are mounted over the weighted elongated shaft 23 at opposite ends thereof. In this embodiment, both the resilient and compressible hand gripping element 25 and the enlarged members 27, 27 are formed from the high density foam rubber material and are assembled over the weighted elongates shaft 23, as illustrated.

The resilient and compressible hand gripping element 25 has a through bore 29 preferably sized to be frictionally retained on the exterior surface of the weighted elongated shaft 23. The outer surface of the resilient and compressible hand gripping element 25 also has a larger intermediate section 31 and smaller end sections 33, 33 which, as shown in the drawings, generally taper towards one another. In this embodiment, a series of circumferential grooves 35 are formed in the larger intermediate section 31, thus providing a series of gripping grooves and ridges to help assure a tight hold onto the resilient compressible hand gripping element 25 during exercise routines.

Figure 5:
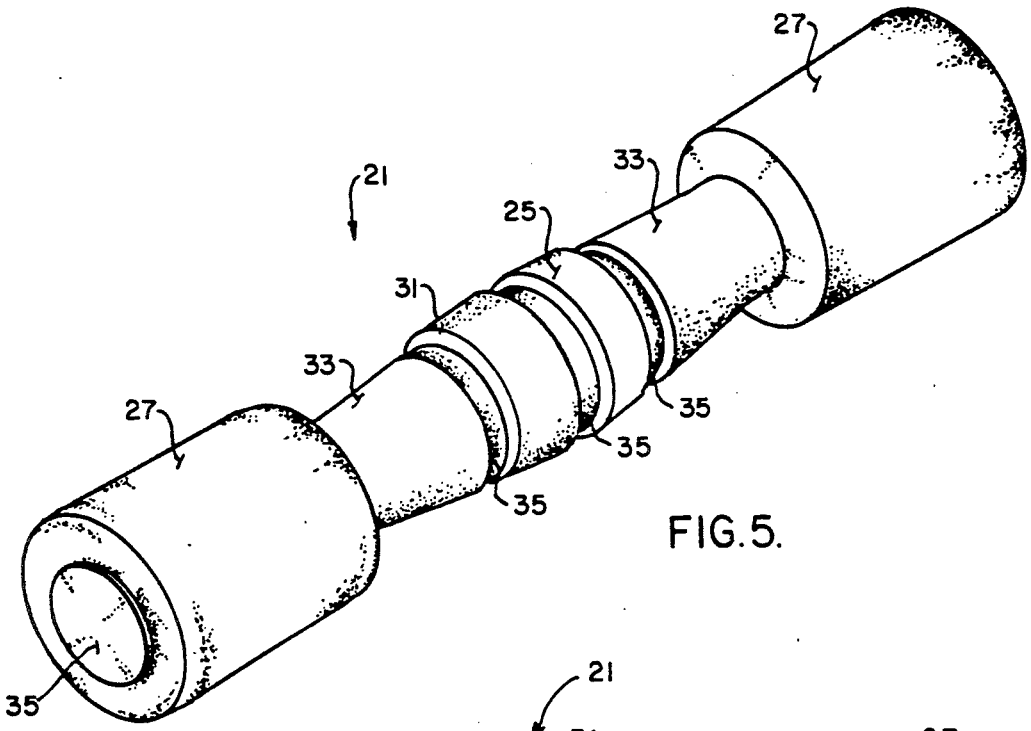
FIGS. 5-8 illustrate a second embodiment which is generally shown as follows.
Figure 6:
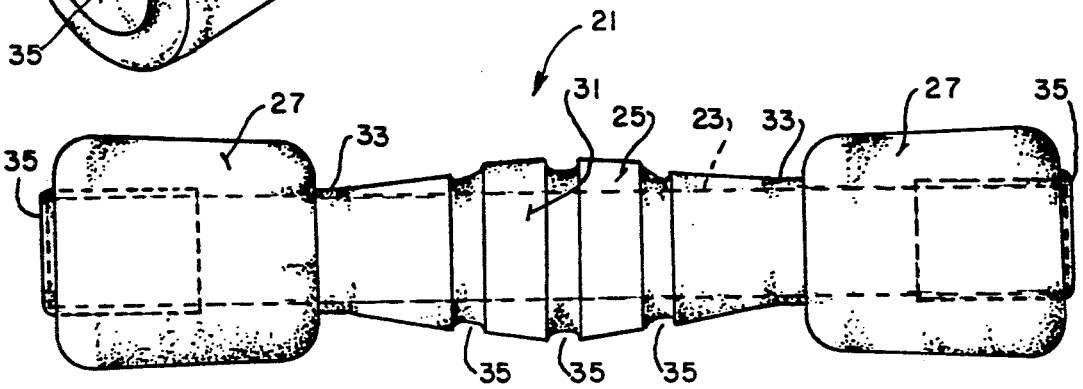
Figure 7:
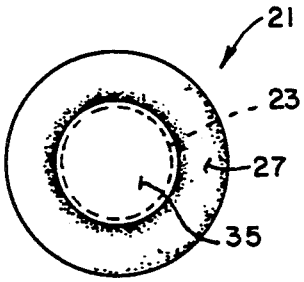
Figure 8:
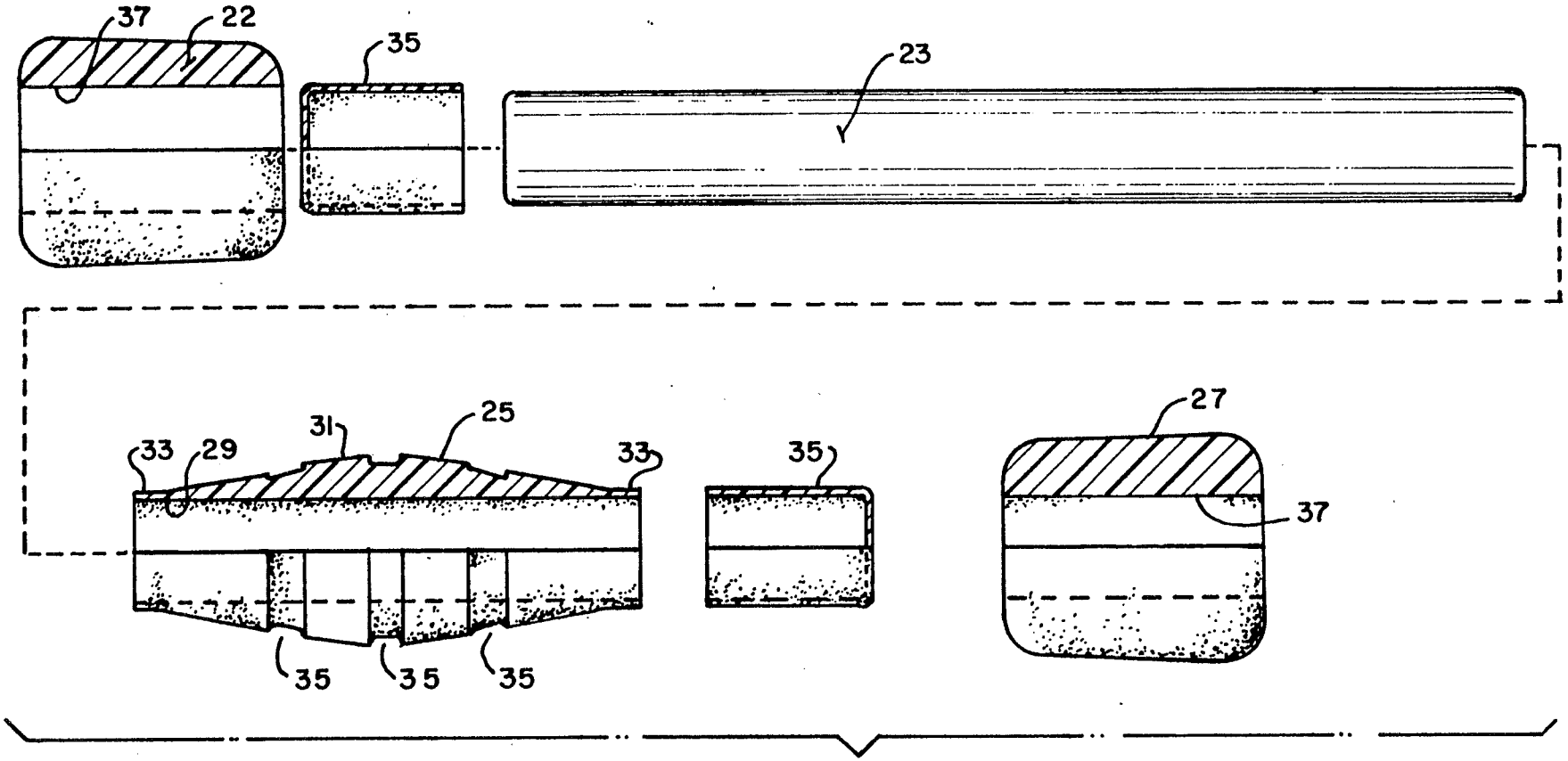

In assembling the components of the user friendly hand held weight 21, the resilient and compressible hand gripping element 25 is first assembled over the weighted elongated shaft 23 and positioned, as illustrated in FIGS. 5–6, to provide room for the enlarged members 27, 27 at opposite free ends thereof. Before the enlarged members 27, 27 are assembled in place, a pair of end caps 35, 35, preferably formed from coarse grain plastic material described above, are suitably formed to fit over the opposite free ends of the weighted elongated shaft 35. For assembling the enlarged members 27, 27 over the weighted elongated shaft 23, through bores 37, 37 are provided and are suitably sized relative to the outer exterior surface of the end caps 35, 35 so as to frictionally engage same. In the FIGS. 5–8 embodiments, the through bore 37 of each of the enlarged members 27 engage the end caps 35 along their entire length, and as seen in FIG. 6, through bores 37 also grip and engage the surface of the weighted elongated bar 23 between the end caps 35 and the smaller end sections 33 of the resilient and compressible hand gripping element 25, as illustrated.

When all of the components are assembled to the user friendly hand held weight 21, they are frictionally retained on the shaft 23 or relative to each other, as is the case of the enlarged members 27 and the end caps 35, such that the user friendly hand held weight 21 can be used during competitive and continuous exercise routines, without any concern that any of the elements will come off. Furthermore, the user friendly hand held weight 21 in the FIGS. 5–8 embodiments provides all of the comfort, safety and durability during use and non-use, as the user friendly hand held weight 1 in the FIGS. 1–4 embodiment. In this embodiment also, the durable and protective covering for the hand gripping element 25 and the enlarged members 27, 27 are both formed from a high density foam rubber material, and can repel perspiration on the outer surfaces of same and can be easily wiped clean. The gripping grooves in the intermediate section of the hand gripping element 25 enable a tighter grip on the hand held element 25, as will be apparent, while also providing a comfortable, safe and durable gripping surface. Because the enlarged members 27, 27 in this embodiment are also formed from the high density foam rubber material, floors and other surfaces which may come into contact with user friendly hand held weight 21 will be further protected since there is a resilient and compressible element between the weighted elongated shaft 23 and a floor or surface against which the user friendly hand held weight 21 may come into engagement.

Reference is now made to the user friendly hand held weight shown in the FIGS. 9–16 embodiment. The general construction of the user friendly hand held weight 41 in this embodiment is also similar in shape and construction to the user friendly hand held weight 21 in the FIGS. 5–8 embodiment, and in addition, an adjustable strap means is provided for adjustably fitting over a user's hand, as will be described.

The general similarities with the FIGS. 5–8 embodiment are that there is a weighted elongated bar 43 with a resilient and compressible hand gripping element 45 (in this case with multiple-sections) and with enlarged members 47, 47 that fit over end caps 49, 49, the latter being first positioned over opposite free ends of the weighted elongated shaft or bar 43. The resilient compressible hand gripping element 25, as well as the enlarged members 47, 47, are also both preferably made from high density foam rubber material, and the end caps 49, 49 are also formed from coarse grain plastic material in a shape and construction similar to the FIGS. 5–8 embodiment.

Some of the differences in this particular embodiment include the fact that the resilient and compressible hand held element is formed of three separate sections. Specifically, there is an intermediate cylindrically shaped section 51 having a circumferential groove 53 formed in the outer surface thereof and two smaller adjacent side sections 55, 55 each with a circumferential groove 57 proximate the end thereof that is positioned adjacent the intermediate section 51. Each of the grooves 53 and 57, 57 in the intermediate and end sections 51 and 55, 55, respectively, function in the manner previously described, when the elements are positioned in juxtaposition relative to one another on the elongated weighted shaft or bar 43. However, the purpose of making a multi-section hand gripping element 45 relates to color versatility, for example, where the intermediate section 51 is manufactured in a color similar to that of the enlarged members 47, 47, while the end or side sections 55, 55 of the hand gripping element 45 are formed in a different color.

The principal difference in the FIGS. 9–16 embodiment from the FIGS. 1–4 and FIGS. 5–8 embodiments is the use of an adjustable strap means 59 for adjustably mounting same to a user's hand when gripping the hand gripping element 45 of the user friendly hand held weight 41. In this regard, the adjustable strap means 59 preferably includes a single strap element 61 that is mounted to the weighted elongated shaft 43 by the strap retainers 63, 63. As shown in FIG. 14A, each strap retainer 63 includes a first opening 65 receiving the weighted elongated shaft 43 between the hand gripping element 45 and the enlarged members 47, 47, on opposite sides of the user friendly hand held weight 41, as illustrated. A curved elongated slot 67 is also provided in each strap retainer 63 for receiving the single strap element 61.

Figure 16:
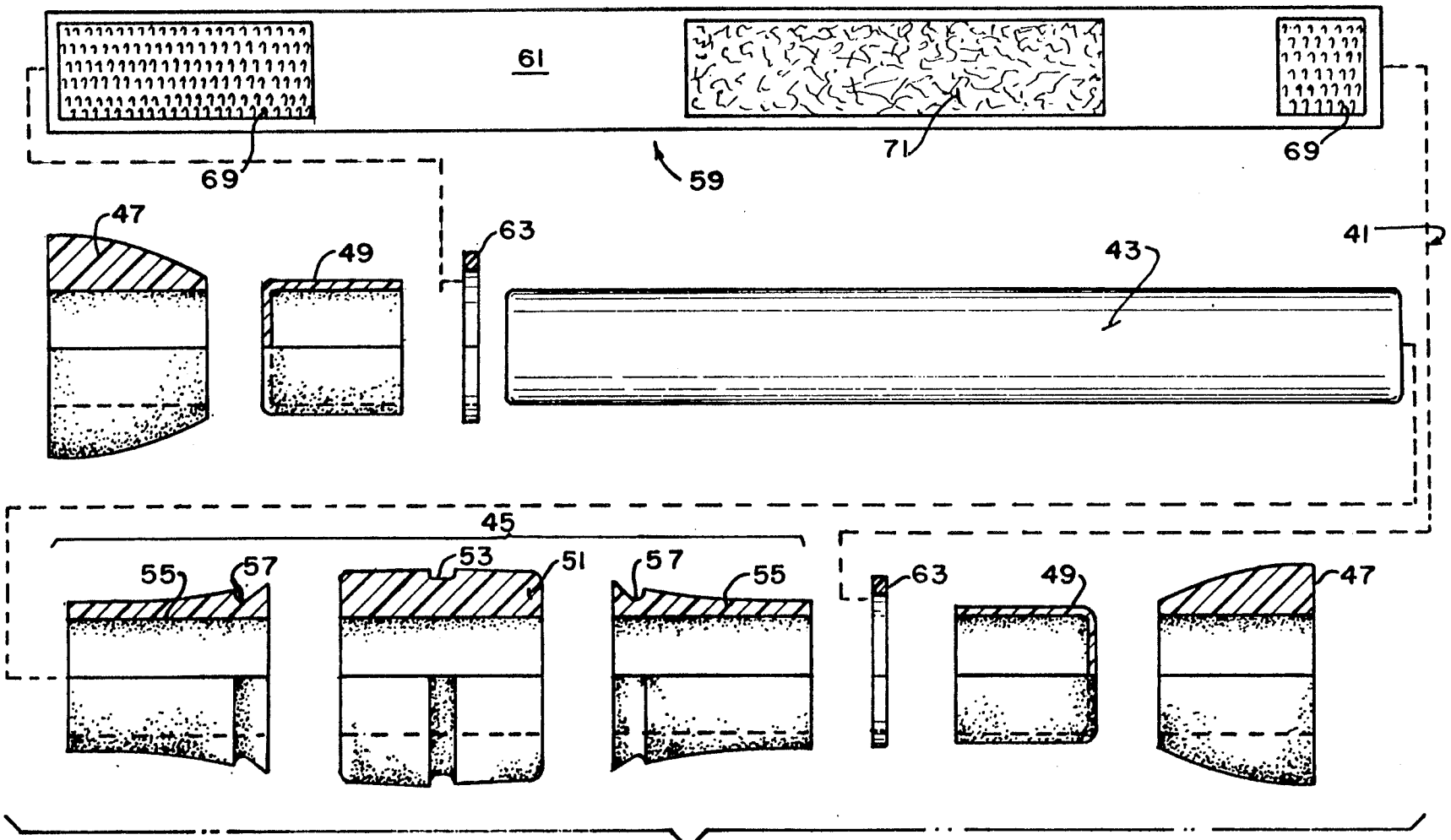
Figure 17:
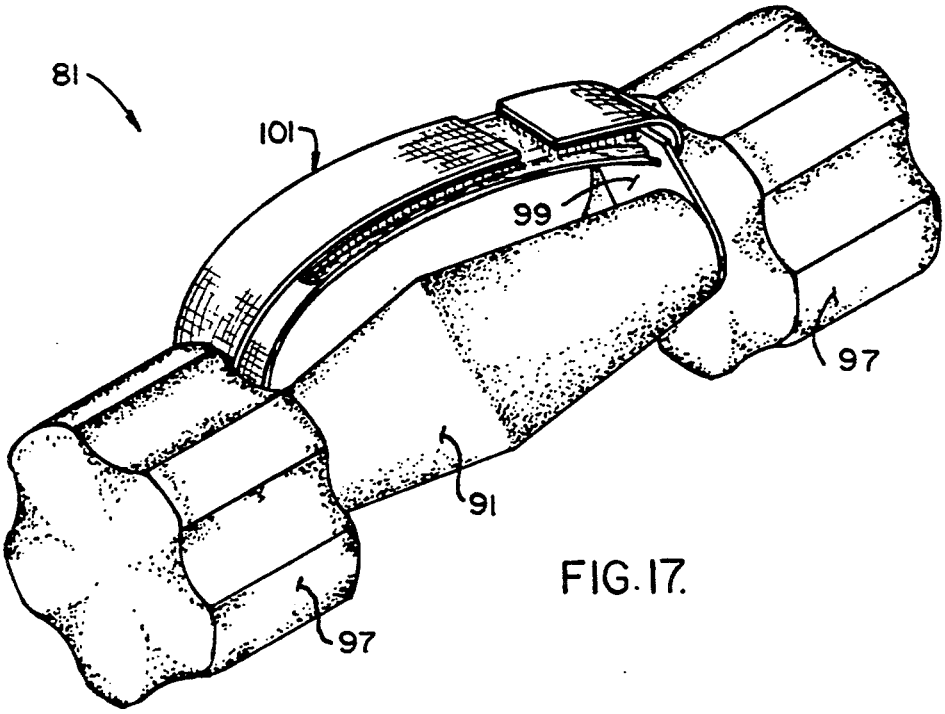
FIGS. 17-24 illustrate a third embodiment which is generally shown as follows.
Figure 18:
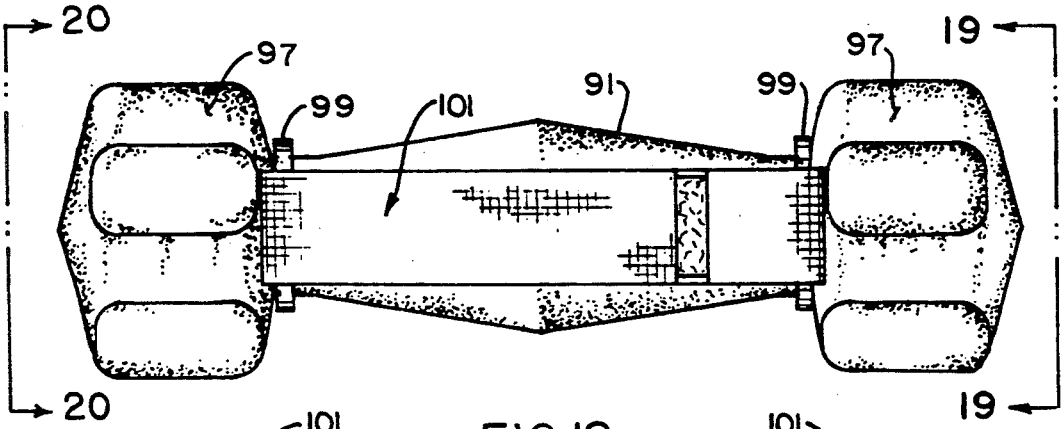
Figure 19:
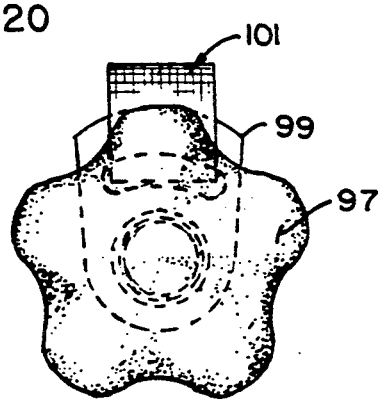
Figure 20:
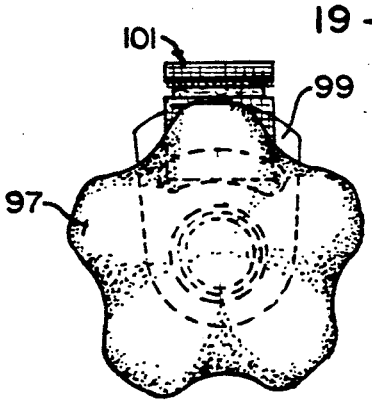
Figure 21:
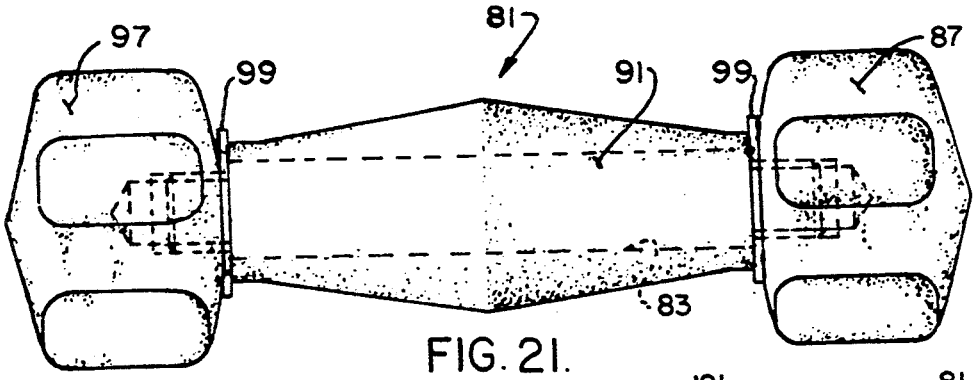
Figure 22:
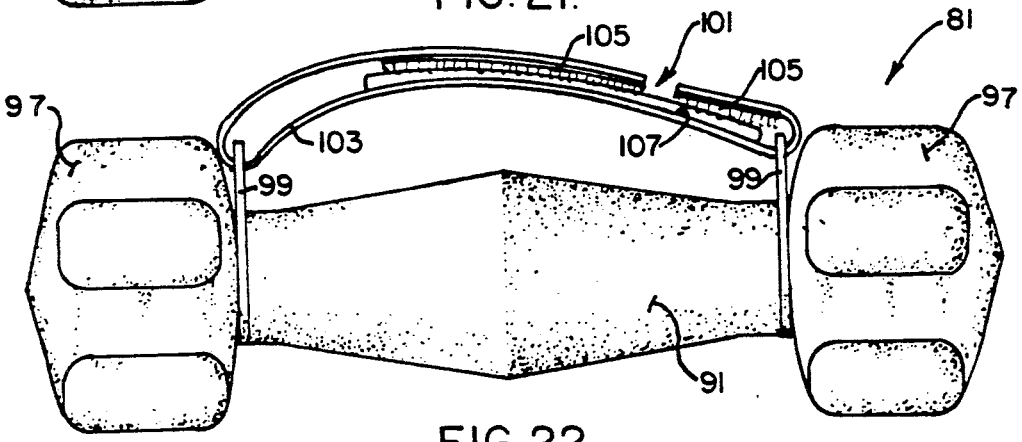

At is best shown in FIG. 16 of the drawings, hook and pile fastener elements are attached to the single strap element 61, with hook type fasteners 69, 69 of different length being provided on opposite ends of the single strap element 61, and a complementary pile fastener 71 attached to the strap element 61 along an intermediate area thereof, the latter also spaced different distances from the longer and shorter hook fastener elements 69, 69 on opposite ends of the strap element 61.

Figure 9:
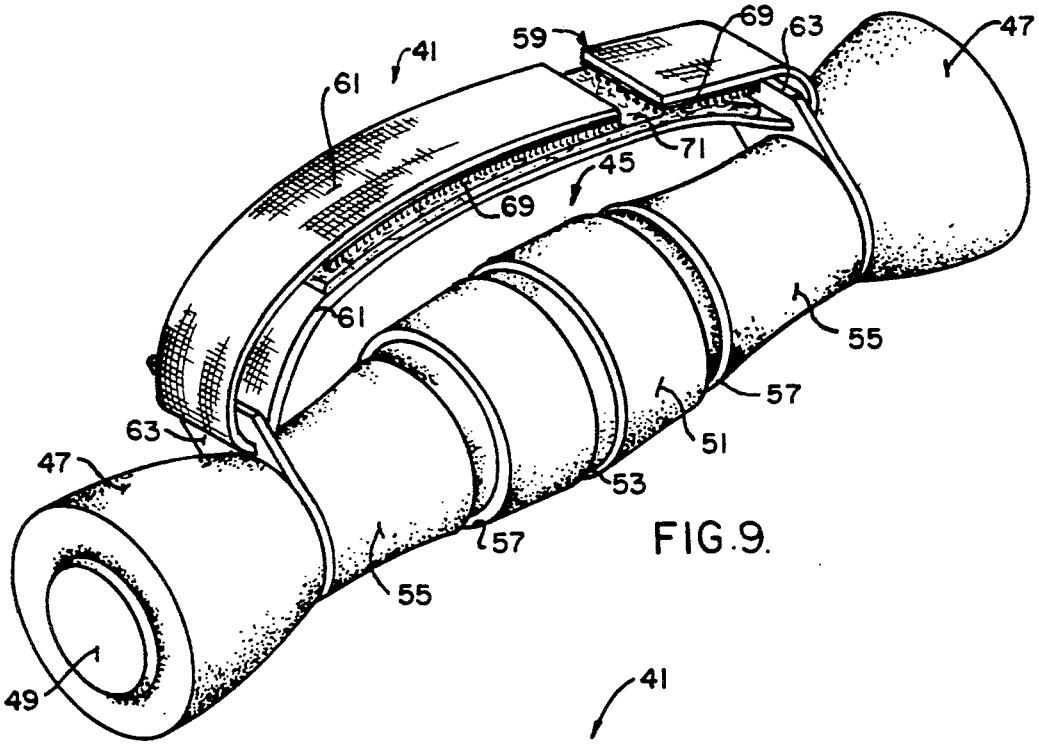
Figure 10:
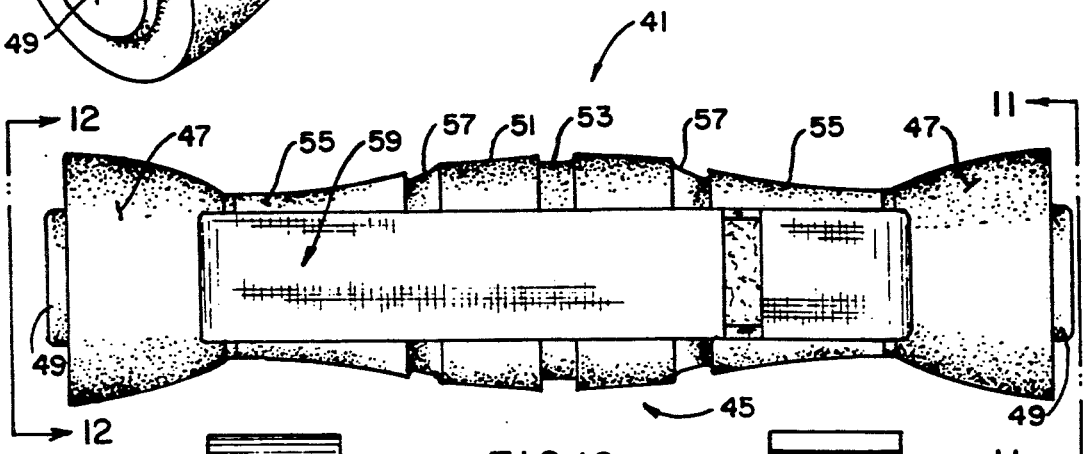
Figure 11:
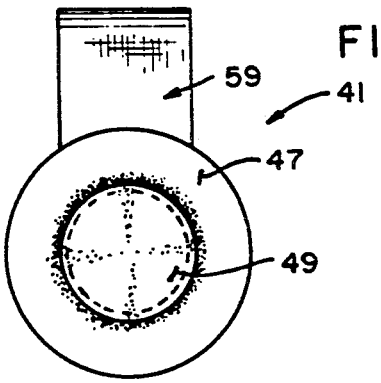
Figure 12:
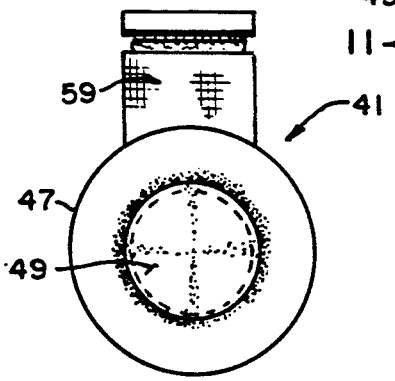

As best seen in FIGS. 9 and 14–15 of the drawings, the single strap element 61 is threaded through the spaced strap retainer 63, 63 in the following manner. The free end of the strap element 61 containing the smaller hook fastener section 69 is threaded through the second opening 67 in the strap retainer 63 on the right hand side of the hand held weight 41, as illustrated in the drawings, and then is folded back on itself to enable the hook and fastener section 69 to engage the complementary pile section 71 in releasable interengagement therewith. The other free end of the strap element 61 is then threaded through the second opening 67 in the other strap retainer 63, as illustrated, and then folded back on itself to enable the longer length hook fastener section 69 to engage the complementary pile section 71 in a releasable interengaged and overlapped relationship, as illustrated in FIGS. 9 and 14 of the drawings.

When it is desired to adjustably fit the strap element 61 to a user's hand, while the user grips the releasable and compressible hand gripping element 45, the user simply uses a second hand to releasably detach the free end of the strap element 61 containing the longer hook fastener element 69, and then pull same so as to tightened the strap element 61 around the back of the user's hand, until the desired fitting is obtained. At that point, the user's second hand re-applies the free end of the single strap element 61, containing the longer hook fastener section 69, to the complementary pile fastener section 71 in the intermediate portion of the strip. This is best illustrated and understood when comparing FIGS. 14–15 of the drawings. Normally, it is unnecessary to detach the other free end of the single strap element 61 containing the smaller hook element section 69, although the user may adjust strap element 61 by detaching both ends, if desired.

As the strap element 61 is pulled tightly over a user's hand prior to re-engaging complementary hook and pile fasteners 69, 71, there is no resiliency or give in the strap element 61 itself. Rather, the strap retainers 63, 63 tend to be pulled to an angular position relative to the elongated shaft 83, as the adjustable strap 59 is adjustably positioned, since the second openings 65, 65 in the strap retainers 63, 63 are larger than the elongated shaft 83 to allow such movement. In addition, the strap retainers 63, 63 may flex or bend slightly, as the adjustable strap 59 is adjustably positioned and fitted to a user's hand. Typically also, there is no resiliency or give in the releasable and compressible hand gripping element 45 because the rubber hardness of the high density foam rubber material, from which the resilient and compressible hand gripping element 45 is made, is sufficiently hard to prevent any resiliency or give when the adjustable strap 59 is adjustably fitted over a user's hand. Resiliency and compressibility of the resilient and compressible hand gripping element 45 occurs when the user subsequently grips same during the exercise routine. In any event, the adjustable strap 59 is securely retained to the hand of a user for comfort and safety during aerobic exercising or aerobic walking, while the resilient and compressible hand gripping element 45 provides a comfortable yet secure grip at the same time.

Reference is now made to the embodiment shown in FIGS. 17–24 of the drawings which includes some of the features shown in the previous embodiments, as well as other features and designs now to be described. In this particular instance, the elongated shaft 83 has opposite threaded ends 85, 85 for threaded engagement with internally threaded sections 87, 87 of enlarged weighted members 89, 89 similar to the FIGS. 1–4 embodiment. Each of the enlarged weighted members 89, 89 are threadably engaged to the elongated shaft 83 and are ergonomically designed with convenient finger engaging sections to facilitate threaded engagement and disengagement of the enlarged weighted members 89 relative to the outer threaded sections 85, 85 of the elongated member 83. As a result, a single elongated shaft 83 can accommodate enlarged weighted members 89, 89 in different sizes, to provide adjustable weight dumbbells for body toning/aerobics at different weight levels.

The user friendly hand held weight 81 in the FIGS. 17–24 embodiment also preferable includes the resilient and compressible hand gripping element 91 located on the non-threaded section of the elongated shaft 83 between the enlarged weighted members 89, 89, at opposite ends thereof. Note that the resilient and compressible hand gripping element 91 includes an intermediate enlarged gripping area 93 which tapers downwardly to smaller end sections 95, 95 at opposite ends thereof, to provide an easy-to-grip configuration for the user. Each of the enlarged weighted members 89, 89 are also provided with the dip molded coarse grain plastic material covering which conforms to the shape of the enlarged weighted members 89, 89, while providing an exterior appearance similar to the high density foam rubber material resilient and compressible hand gripping element 91. Thus, the durable and protective coating for the user friendly hand held weight 81 provides comfort, safety and durability for the user during use, while protecting the floor or other surfaces from damage, in the same manner as the other as the other embodiments.

Figure 23:
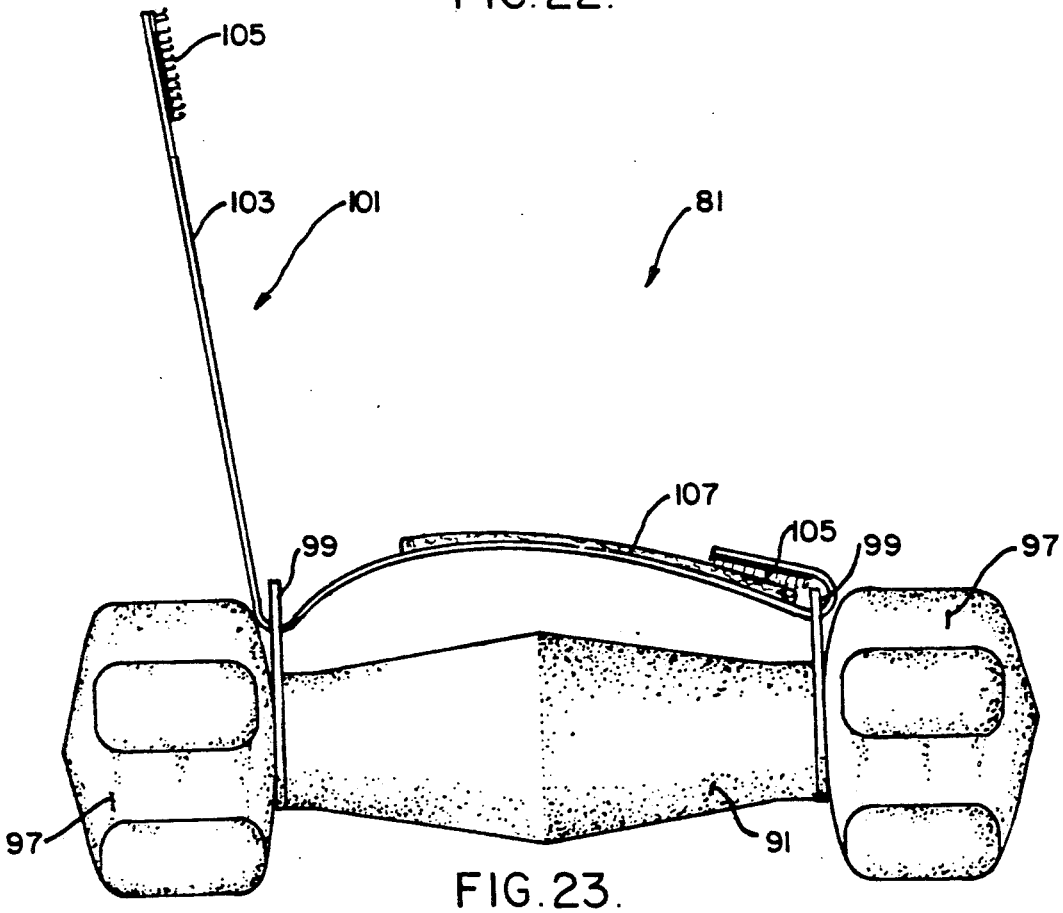
Figure 24:
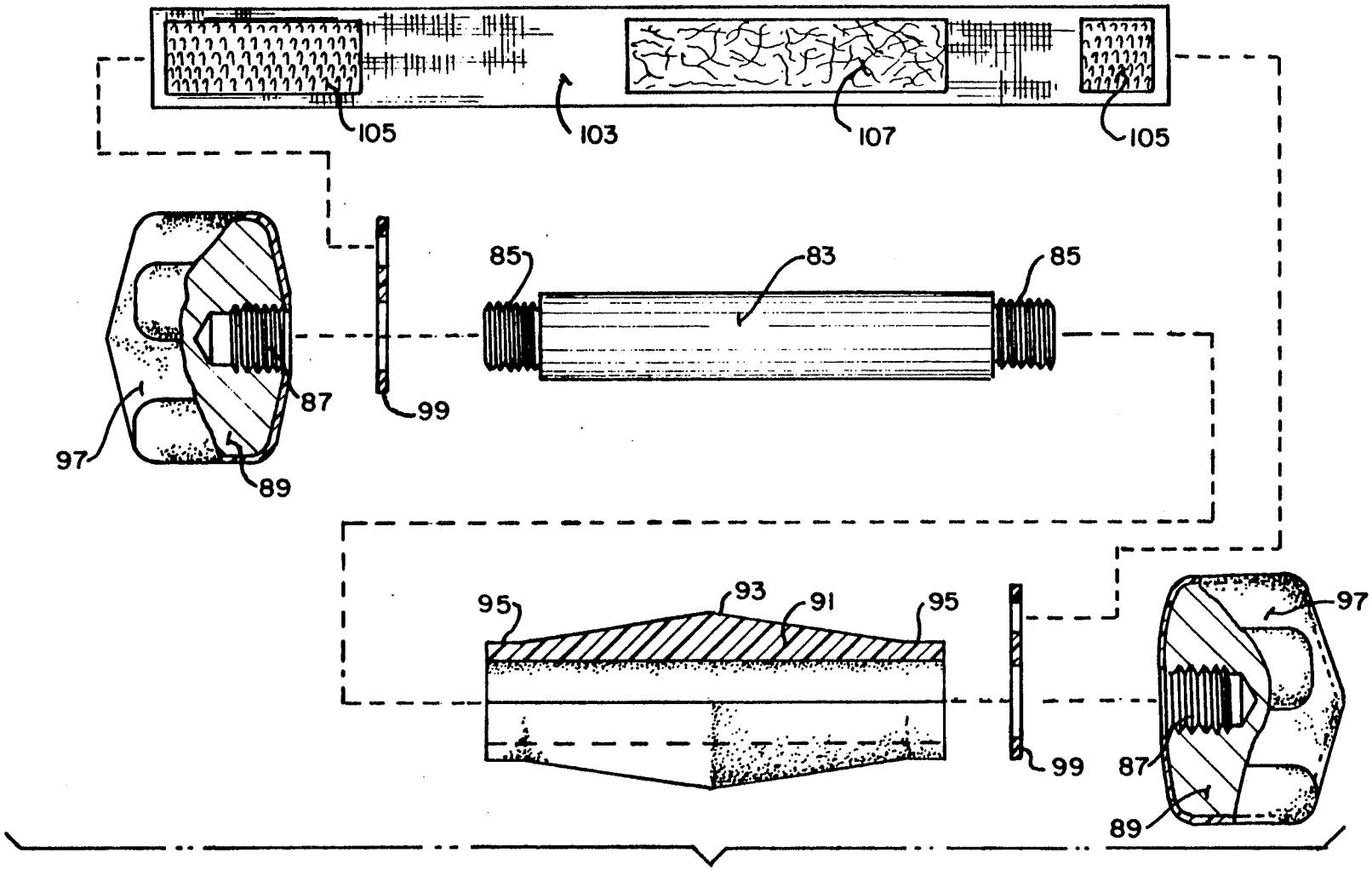

The user friendly hand held weight 81 is further provided with strap retainers 99, 99 which are positioned on the shaft 83 between the ends of the hand held element 91 at opposite ends thereof and the durable and protective enlarged weighted members 89. Each of the strap retainers 99, 99 include first and second openings (see FIGS. 19–20 and 24) similar to the strap retainers 63, 63 illustrated in FIG. 14A, with the larger opening receiving the threaded ends 85, 85 of the elongated shaft 83, and the second opening receiving the single strap element 103 to provide an adjustable strap 101 which operates in the same manner as the FIGS. 9–16 embodiment. In this connection, note that the single strap element 101 includes longer and shorter length hook fastener sections 105, 105, at opposite ends of the single strap element 101 and a generally intermediate complementary pile section 107, as best shown in FIG. 24, for use in the same manner in the FIGS. 9–16 embodiment. Thus, as shown in FIG. 23, when it is desired to adjust the strap 101 relative to a user's hand, while gripping hand gripping element 91, a second hand of the user releasably detaches one end of the strap element 101, usually the end containing the longer hook fastener section 105, and then pulls the strap element 101 to adjustably tighten and fit the strap element 101 over the user's hand, following which the detached strap then is re-attached, for adjusted fitted engagement relative to a user's hand.

With the above construction as shown in FIGS. 17-24, the user friendly hand held weight not only provides an adjustable strap 101 for adjustable fitted engagement relative to a user's hand, but also provides flexibility, if desired, by threadably or otherwise disassociating enlarged weighted elements 89, 89 from the opposite threaded ends 85, 85 of the elongated shaft 83 and replacing same with smaller or larger generally ergonomically designed weights, as will be appreciated.

From the foregoing, it will now be appreciated that the present invention provides a variety of styles and constructions for one or more user friendly hand held weights. All of the user friendly hand held weights are provided with surrounding protective and durable coverings, for both the elongated shaft and enlarged members, to provide comfort, safety and durability during use, and protection against damages to surfaces when not in use. The ergonomically designed resilient and compressible hand gripping elements and/or enlarged members at opposite ends of the elongated shaft facilitate gripping and use of the hand held weights, to provide a comfortable, safe and effective workout, as may be desired. Enlarged weighted members may be either permanently secured to the elongated shaft or, if desired, may be adjustably removed from the elongated shaft for replacement by different size weighted members for body toning/aerobic exercises. In addition to the above, an adjustable strap is utilized in one or more of the various user friendly hand held weights for holding a user's hand in an adjustable and fitted relationship, when gripping the dumbbell elongated shaft. The above features are typically employed in smaller single hand held weights or dumbbells, but could also be used in large dumbbells where two hands are required.

In view of the above, it will be seen that the several objects and features of this invention are achieved and other advantageous results obtained.

As various changes could be made in the above constructions without departing from the scope of the invention, it is intended that all matter contained in the above description or shown in the accompanying drawings shall be interpreted as illustrative and not in a limiting sense.

We claim:

1. A dumbbell comprising an elongated shaft, enlarged weight members attached to opposite free ends of said elongated shaft, said elongated shaft and said enlarged members each having surrounding protective and durable covering means that is user friendly during use while protecting supporting and other surfaces against damage when the dumbbell is not in use, said elongated shaft protective and durable covering means including a resilient and compressible high density foam rubber covering to repel perspiration and afford a comfortable grip, said resilient and compressible high density foam rubber covering also being sculptured to provide generally cylindrical end sections adjacent each said enlarged member and a larger in diameter elongated and circumferentially curvilinear section intermediate said end sections, and said protective and durable covering means for each enlarged weight member including a molded coarse grain textured covering that surrounds and conforms to each said enlarged weight member and repels perspiration, said molded coarse grain textured covering for each said enlarged weight member being generally similar in overall exterior appearance to said resilient and compressible high density foam rubber covering.

2. The dumbbell as defined in claim 1 wherein said resilient and compressible high density foam rubber covering comprises a one-piece element.

3. The dumbbell as defined in claim 1 wherein the intermediate section of said resilient and compressible means gently tapers downwardly on opposite sides thereof to said generally cylindrical end sections adjacent said enlarged weight members.

4. The dumbbell as defined in claim 3 wherein at least the larger intermediate section of said resilient and compressible means is provided with groove means to facilitate gripping.

5. The dumbbell as defined in claim 3 wherein the larger intermediate section and smaller end sections of said resilient and compressible means are provided with groove means to facilitate gripping.

6. The dumbbell as defined in claim 1 wherein said enlarged weight members comprise weights which are threadably and releasably attached to said elongated shaft at opposite ends thereof.

7. The dumbbell as defined in claim 1 wherein the molded coarse grain textured covering for each said enlarged weight members have a different and brighter color than said resilient and compressible high density foam rubber covering for said elongated shaft to provide color coding of said dumbbell.

8. The dumbbell as defined in claim 1 and further including adjustable strap means for adjustably fitting the dumbbell to a user's hands.

9. The dumbbell as defined in claim 8 wherein the adjustable strap means includes spaced strap retainers associated with said elongated shaft and an adjustable strap operatively associated with said spaced strap retainers.

10. The dumbbell comprising an elongated shaft, a resilient and compressible high density foam rubber element extending along at least a substantial portion of the elongated shaft to facilitate gripping and use of the dumbbell while repelling perspiration, and enlarged members attached to opposite free ends of said elongated shaft, said enlarged members comprising sculptured resilient and compressible high density foam rubber bodies each having a through passageway for receiving one of the opposite ends of said elongated shaft, at least part of the diametrical extent of each of said sculptured resilient and compressible high density foam rubber bodies being greater than that of said resilient and compressible high density foam rubber element, in order to enable said enlarged member high density foam rubber bodies and said elongated shaft and associated resilient and compressible high density foam rubber element to be provided with a dumbbell shape.

11. The dumbbell as defined in claim 10 wherein the high density foam rubber bodies at opposite ends of said elongated shaft have a different and brighter color than said foam rubber element for color coding of said dumbbell.

12. The dumbbell as defined in claim 10 wherein each of the foam rubber bodies comprises an enlarged cylindrically shaped element.

13. The dumbbell as defined in claim 12 wherein each of the foam rubber bodies comprises a reversibly tapering body section which extends upwardly and outwardly from said foam rubber element to an outer free extremity thereof.

14. The dumbbell as defined in claim 12 and further including opposite end caps each of which fits over opposite ends of said elongated shaft, each said end cap being trapped between an associated foam rubber body and said elongated shaft.

15. The dumbbell as defined in claim 13 and further including opposite end caps each of which fits over opposite ends of said elongated shaft, each said end cap being trapped between an associated foam rubber body and said elongated shaft.

16. A dumbbell comprising an elongated shaft surrounded by a resilient and compressible high density foam rubber element that is comfortable to grip while repelling perspiration, enlarged members attached to opposite free ends of said elongated shaft, and selectively adjustable strap means for individual conformable relative tight fitting engagement around the back of a user's hand when gripping the foam rubber element along elongated shaft in order to secure the user's hand to the dumbbell during exercise, said adjustable strap means extending along said elongated shaft and associated foam rubber element and being operatively secured to said dumbbell in the vicinity of and spaced inwardly of said enlarged members, and adjustable strap means including spaced and overlapping longitudinally extending strap elements each having adjustable releasable fastening means for cooperative adjustable interengagement when positioned in overlapping engagement to one another, and said adjustable strap means and said resilient and compressible foam rubber element surrounding said elongated shaft cooperating to secure said dumbbell to a user's hand while providing a comfortable and perspiration repelling grip during exercise.

17. The dumbbell as defined in claim 16 wherein the enlarged members have a different and brighter color than at least a substantial portion of said foam rubber element for color coding of said dumbbell.

18. The dumbbell as defined in claim 16 wherein the adjustable strap means comprises a single strap element which is connected to spaced strap retainers each mounted on said elongated shaft adjacent to and spaced inwardly from said enlarged members.

19. The dumbbell as defined in claim 18 wherein each strap retainer includes a first opening for receiving said elongated shaft and a second opening for receiving the single strap element.

20. The dumbbell as defined in claim 19 wherein the spaced adjustable strap releasable fastening means on said single strap element includes complementary hook and pile fasteners.

21. The dumbbell as defined in claim 20 wherein each end of said single strap element is provided with one of said hook and pile fasteners and an intermediate area of said single strap element is provided with the other of said hook and pile fasteners, said single strap element being folded over one of said strap retainers adjacent each end thereof to enable said complementary hook and pile fasteners to engage one another, the intermediate area of said single strap element containing the other of said hook and pile fasteners being spaced a longer distance from one of said hook and pile fasteners at the other end of said single strap element to permit adjustable interfitting of said complementary hook and pile fasteners to one another.

22. The dumbbell as defined in claim 20 and including a molded coarse grain textured covering surrounding and conforming to each said enlarged member, said molded coarse grain textured covering being generally similar in overall appearance to said foam rubber element.

23. The dumbbell as defined in claim 20 and including at least partially enlarged foam rubber bodies each with a through passageway which is mounted to an opposite end of said elongated shaft to form said enlarged members.

24. The dumbbell as defined in claim 23 wherein each strap retainer is slidably mounted on said elongated shaft and trapped between said foam rubber element and said foam rubber bodies at one of said opposite ends of said elongated shaft to prevent movement thereof.

* * * * *